US007806031B1

(12) United States Patent
Rytz et al.

(10) Patent No.: US 7,806,031 B1
(45) Date of Patent: Oct. 5, 2010

(54) DEVICE FOR FINELY CUTTING WORKPIECES FROM A MATERIAL

(75) Inventors: Ernst Rytz, Suberg (CH); Hans-Rudolf Gubler, Gebenstorf (CH)

(73) Assignee: Feintool International Holding AG, Lyss (CH)

( * ) Notice: Subject to any disclaimer, the term of this patent is extended or adjusted under 35 U.S.C. 154(b) by 865 days.

(21) Appl. No.: 10/018,609

(22) PCT Filed: Jun. 20, 2000

(86) PCT No.: PCT/EP00/05681

§ 371 (c)(1),
(2), (4) Date: Feb. 11, 2002

(87) PCT Pub. No.: WO01/00396

PCT Pub. Date: Jan. 4, 2001

(30) Foreign Application Priority Data

Jun. 25, 1999 (DE) ..... 199 29 163

(51) Int. Cl.
*B26F 1/14* (2006.01)

(52) U.S. Cl. ..... 83/390; 83/685; 83/639.1

(58) Field of Classification Search ..... 83/55, 83/130, 639.1, 639.5, 685, 694, 615, 623, 83/374–377, 390, 697, 684, 196–200; 72/453.13
See application file for complete search history.

(56) References Cited

U.S. PATENT DOCUMENTS

| | | | | |
|---|---|---|---|---|
| 2,092,092 | A * | 9/1937 | Sinclair et al. | 100/35 |
| 3,570,343 | A * | 3/1971 | Wolnosky et al. | 83/124 |
| 3,802,310 | A * | 4/1974 | Maurer | 83/527 |
| 3,827,328 | A * | 8/1974 | LaFlamme et al. | 83/617 |
| 4,203,359 | A * | 5/1980 | Baltschun | 100/209 |
| 4,905,556 | A * | 3/1990 | Haack et al. | 83/639.5 |
| 5,136,521 | A * | 8/1992 | van Daalen et al. | 700/160 |
| 5,673,601 | A * | 10/1997 | Ejima et al. | 83/13 |
| 5,749,279 | A * | 5/1998 | Gardner | 83/639.1 |
| 6,240,818 | B1 * | 6/2001 | Baltschun | 83/137 |
| 6,408,726 | B1 * | 6/2002 | Taijonlahti et al. | 83/563 |

FOREIGN PATENT DOCUMENTS

DE 4338197 C1 * 1/1995

* cited by examiner

*Primary Examiner*—Kenneth E. Peterson
*Assistant Examiner*—Sean Michalski
(74) *Attorney, Agent, or Firm*—Bachman & LaPointe, P.C.

(57) ABSTRACT

A device for finely cutting workpieces from a material, which includes a press plate which is subjected to the pressure of a knife-edged ring cylinder consisting of a knife-edged ring and a clipping punch which is guided in the pressing plate, and associated with a blanking die with a counter holder (ejector) on a tappet, whereby the tappet is placed against at least one compensation cylinder which is hydraulically connect to the knife-edged ring cylinder.

6 Claims, 3 Drawing Sheets

DEVICE FOR FINELY CUTTING WORKPIECES FROM A MATERIAL

BACKGROUND OF THE INVENTION

The invention relates to an apparatus for the fine blanking of workpieces from a material, comprising a press plate, which is under the pressure of a V-ring cylinder and has a V-ring, and a blanking punch which is guided in the press plate and to which a die plate with counterholder (ejector) is assigned at a ram.

The working principle of fine blanking is shown and described in "Feinschneiden", Handbuch für die Praxis, publisher Feintool AG Lyss, 2nd edition, 1977, pages 15 to 17. A fine-blanking tool essentially comprises a press plate with V-ring, in which a blanking punch is guided. A counterholder or ejector in a die plate is assigned to the blanking punch in a position opposite the latter.

A workpiece, for example a metal sheet, is inserted between press plate and blanking punch or die plate and counterholder. The top part and the bottom part of the tool are closed and the workpiece is clamped in position inside and outside the cutting line by means of a V-ring force and a counterforce. The press plate and the die plate are guided relative to the blanking punch and counterholder and thus the workpiece is cut out of the material. After the workpiece has been cut out, the tool is opened and the workpiece is usually ejected from the die plate by means of the counterholder.

In these conventional fine-blanking presses, the force of the V-ring cylinder, which is usually arranged in the top crosshead of the machine column, opposes the blanking force. The counterholder cylinder, which is integrated in the ram or in the working piston, also presses the workpiece against the top part of the tool; the counterholder supporting force likewise opposes the blanking force. The counterforce of the V-ring cylinder may be up to 50% and that of the counterholder up to 25% of the working force. However, this considerably reduces the capacity of the entire apparatus.

To solve this problem, DE 196 42 635 A1 proposes that V-ring cylinder and counterholder cylinder be arranged in a different way, the V-ring cylinder being integrated in a separate crosspiece above the column and being connected to the ram via pillars, so that it moves upward in synchronism with the ram. The counterholder cylinder is in turn arranged between the ram and a bottom crosshead of the column, no relative movement taking place between counterholder cylinder and column during stroke, so that the supporting forces of the counterholder cylinder are absorbed by the machine column.

Apart from the fact that this apparatus is of very complicated construction and has to work with various hydraulic operating circuits, it has been found that, for strength reasons, the crosspiece for the V-ring cylinder has to be of very solid construction. This in turn requires a configuration as a heavy and expensive machine, so that the energy saving due to the traveling V-ring cylinder is nullified by this large mass to be moved during each stroke. In addition, assembly is very difficult.

SUMMARY OF THE INVENTION

The object of the present invention is to provide an apparatus of the above-mentioned type in which the force of the V-ring cylinder is compensated for in a simple manner and the construction of which is substantially simplified.

This object is achieved by the ram being supported against at least one compensation cylinder which is hydraulically connected to the V-ring cylinder.

In this case, the compensation cylinder is designed in such a way that it is in hydraulic equilibrium with the V-ring cylinder. This means that the force of the V-ring cylinder is absorbed and compensated for by the compensation cylinder during each ram stroke, so that it has no effect on the actual ram stroke.

For reasons of force distribution, it would probably be appropriate to distribute the counterforce produced by the compensation cylinders over a plurality of compensation cylinders. In the present exemplary embodiment, four compensation cylinders are intended, although, depending on the press and the embodiment, more or fewer compensation cylinders are possible.

The compensation cylinder is firmly connected to the ram via a piston rod on a piston. It is subjected to the same pressure as a piston in the V-ring cylinder, this pressure equilibrium being produced in the simplest way by an effective cross-sectional area of the compensation pistons corresponding to the effective cross-sectional area of the piston of the V-ring cylinder. As a result, no additional pressure supply elements are required for maintaining the same pressures on both pistons. It is sufficient if the two working spaces of V-ring cylinder and compensation cylinder are hydraulically connected to one another via a line. The equal cross-sectional areas of the pistons then exert an equal pressure on the press plate or the die plate or the ram.

For the sake of simplicity, the V-ring cylinder is arranged on a crosshead of the machine frame, so that an additional crosspiece is dispensed with. The moving mass is thus substantially smaller during a ram stroke, so that the expenditure of energy per stroke and the weight of the machine can be kept substantially smaller. No additional connecting frame (crosspiece) is necessary, so that the construction becomes substantially simpler and more favorable.

The assembly possibilities are substantially improved and the machine height is reduced.

Should it prove to be necessary, in the case of a rapid motion of the machine, for the oil exchange between V-ring cylinder and compensation cylinder to be accelerated, an oil tank can be added to the connection via an appropriate logic valve, so that a large oil quantity, which is briefly necessary, can be drawn in from the oil tank via the logic valve.

Figure 1:
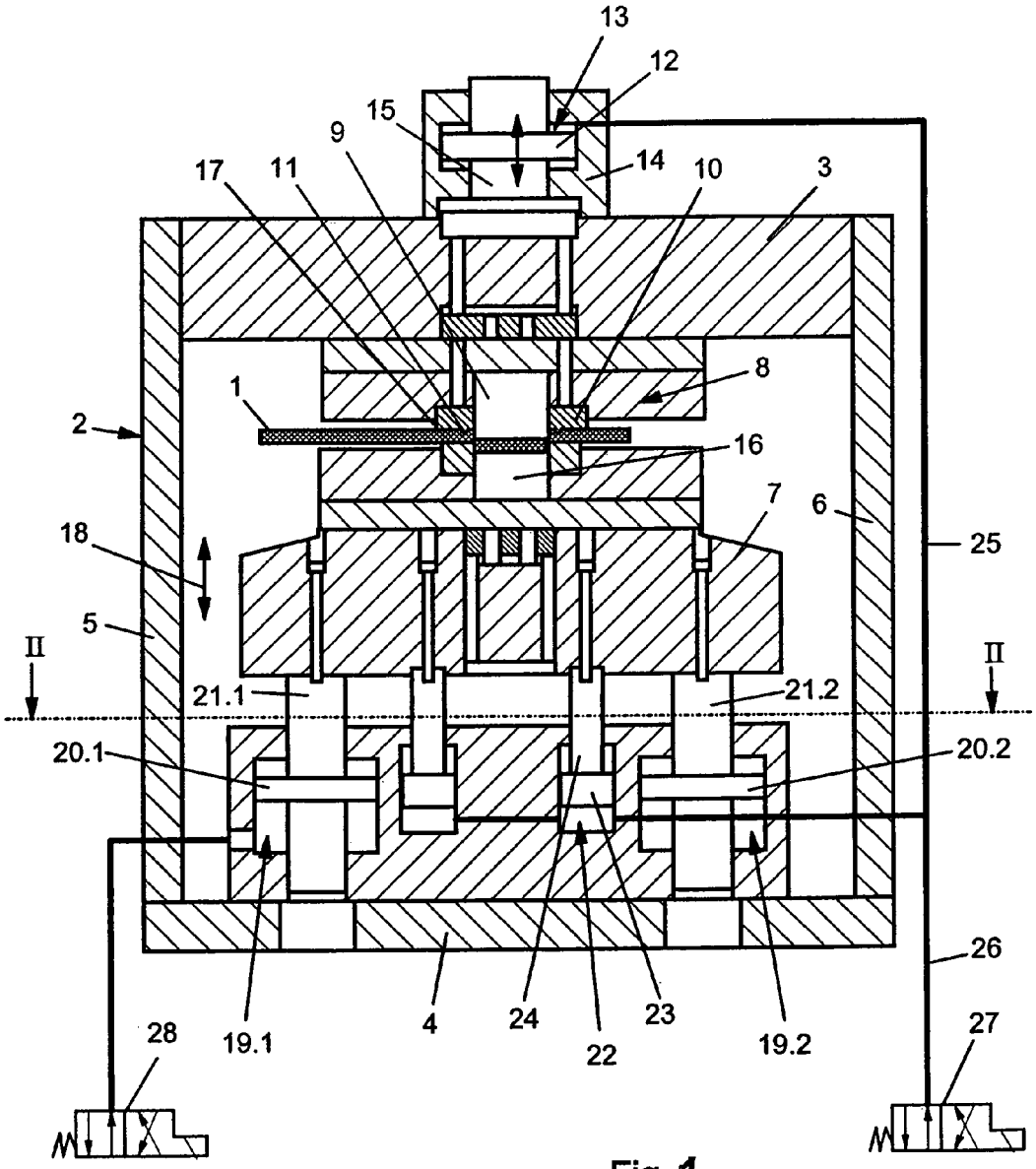
FIG. 1 is a side view of an apparatus according to the invention.

Further, advantages, features and details of the invention follow from the description below of a preferred exemplary embodiment and with reference to the drawing.

DETAILED DESCRIPTION

Referring to FIG. 1, a cross section is shown through an apparatus according to the invention for the fine blanking of workpieces from a material, for example from a metal sheet 1. This metal sheet passes through a machine frame 2 between a crosshead 3 and a base 4. Side walls are identified by 5 and 6.

A fine-blanking tool 8, as generally known, is provided between the crosshead 3 and a ram 7. Reference is made in this respect to the book "Feinschneiden" Handbuch für die Praxis, publisher: Feintool AG Lyss, 2nd edition, 1977, pages 15 to 17.

Such a fine-blanking tool 8 has a blanking punch 9 which is guided in a press plate 10. Toward the metal sheet 1, this press plate 10 has a V-ring 11. The press plate 10 is supported in the opposite direction against a V-ring piston 12 in a V-ring cylinder 13. The V-ring cylinder 13 is located in a corresponding housing 14 on the crosshead 3, the V-ring piston 12 being connected through the crosshead 3 to the press plate 10 via a piston rod 15 and various pressure plates and rams (not identified in any more detail).

At the ram 7, a counterholder 16, which may also serve as ejector, is assigned to the blanking punch 9. The hydraulics for applying pressure to this counterholder 16 are not to be described here in any more detail. They are described in the above-mentioned manual.

Figure 3:
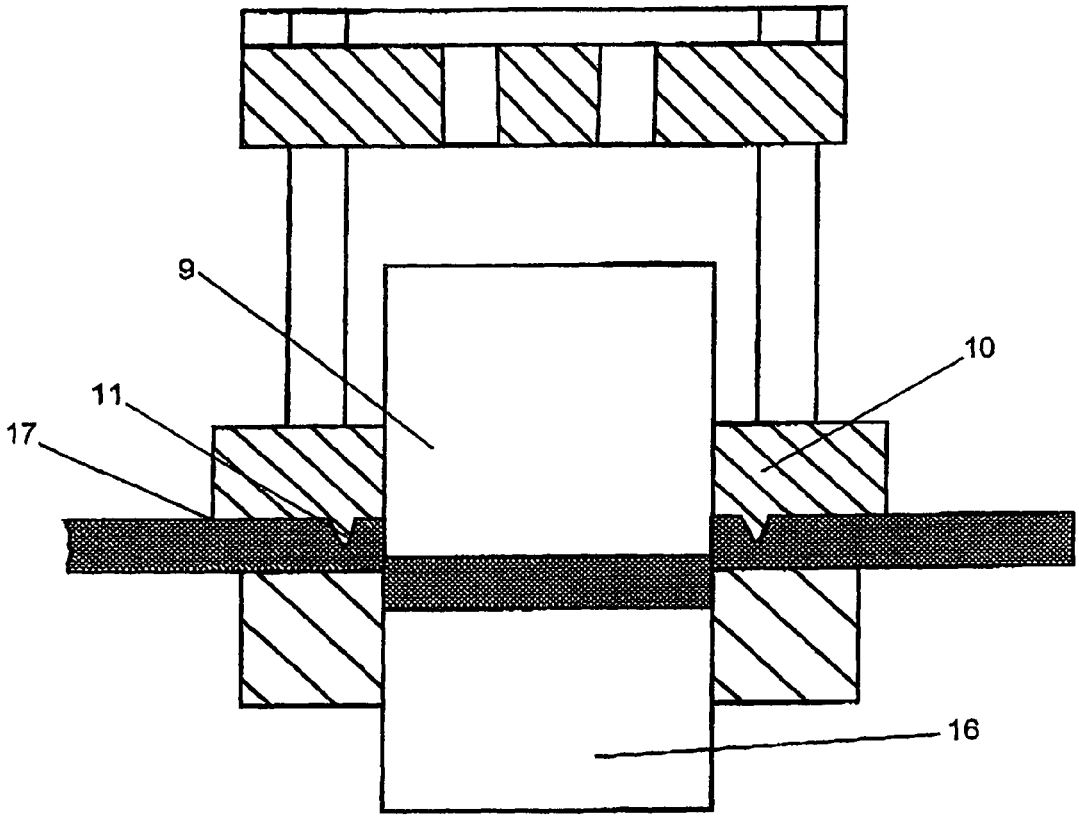
FIG. 3 further illustrates an enlarged view of the V-ring, die plate, blanking punch, and counter-holder of FIG. 1.

The counterholder 16 is guided in a die plate 17, the blanking punch 9 pressing the workpiece to be cut out into this die plate 17, in the course of which the counterholder 16 gives way (See FIG. 3).

The stroke of the ram 7 in the direction of the double arrow 18 is effected via two main cylinders 19.1 and 19.2, in which a piston 20.1 and 20.2 is guided in each case. Each piston 20.1 and 20.2 is firmly connected to the ram 7 via a piston rod 21.1 and 21.2.

Figure 2:
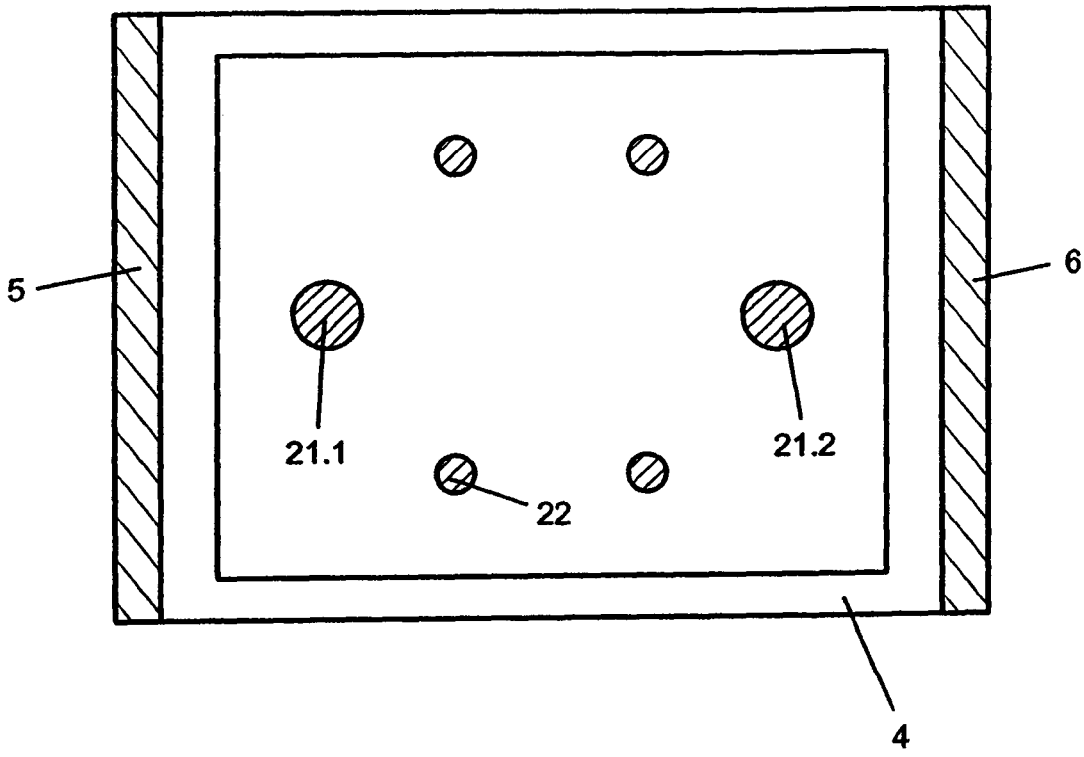
FIG. 2 further illustrates an embodiment of the invention having four compensation cylinders.

According to the invention, however, the ram 7 is also supported against preferably four compensation cylinders 22 (See also FIG. 2), only one being described below. Guided in the compensation cylinder 22 is a compensation piston 23, which in turn is firmly connected to the ram 7 via a piston rod 24. According to the invention, the compensation piston or pistons 23 have an effective cross-sectional area which corresponds to that of the V-ring piston 12. Furthermore, the V-ring cylinder 13 and the compensation cylinder 22 are coupled to one another via a hydraulic connection 25. An oil tank (not shown in any more detail) can be connected in this hydraulic connection 25 via further connection 26 and logic valve 27.

The two main cylinders 19.1 and 19.2 are also connected to one another and via a valve 28 to an oil tank (not shown in any more detail).

The mode of operation of the present invention is as follows:

When tool 8 is opened, a metal sheet 1, from which a workpiece is to be cut, is inserted between the blanking punch 9 and the die plate 17 or the press plate 10 and the counterholder 16.

The ram 7 is raised by means of the two main cylinders 19.1 and 19.2, the metal sheet 1 being clamped in place between the die plate 17 and press plate 10. In the process, the V-ring 11 is pressed into the metal sheet 1. The forces which emanate from the V-ring cylinder 13 in the process are neutralized by the compensation cylinders 22, since their pistons together have the same effective cross-sectional area as the piston 12 of the V-ring cylinder.

During a further ram stroke, the blanking punch 9 presses the workpiece to be cut out into the die plate 17, in the course of which the counterholder 16 gives way.

Once the workpiece has been cut out of the metal sheet, the machine opens, and the counterholder 16 can eject the workpiece from the die plate 17.

If the device is operated with a rapid motion, it is possible that an oil exchange will not take place quickly enough via the connection 25. In this case, a large oil quantity, which is briefly necessary, can be drawn in from the oil tank via the logic valve 28.

The invention claimed is:

1. An apparatus for fine blanking of workpieces from a material (1), comprising:

a press plate (10) having a V-ring (11), which is under pressure from a V-ring cylinder (13) comprising a V-ring piston rod (15) connected to a V-ring piston (12) disposed opposite to and in support of the V-ring (11) of the press plate (10), and a blanking punch (9) which is guided in the press plate (10) and to which a die plate (17) with counterholder (16) is assigned at a ram (7), wherein the ram (7) is supported against at least one compensation cylinder (22) and against at least one main cylinder (19.1, 19.2), and wherein the at least one compensation cylinder (22) is hydraulically connected to the V-ring cylinder (13) through a hydraulic connection (25) and is in hydraulic equilibrium with the V-ring cylinder (13), said hydraulic connection (25) also having a connection (26) to an oil tank via a logic valve (27).

2. The apparatus as claimed in claim 1, characterized in that four compensation cylinders (22) are provided.

3. The apparatus as claimed in claim 1, characterized in that a compensation piston (23) is arranged in the compensation cylinder (22) and is firmly connected to the ram (7) via a piston rod (24).

4. The apparatus as claimed in claim 3, characterized in that an effective cross-sectional area of the compensation piston (23) is equal to an effective cross-sectional area of the V-ring piston (12) of the V-ring cylinder.

5. The apparatus as claimed in claim 1, characterized in that a piston (20.1, 20.2) of the main cylinder (19.1, 19.2) has an effective cross-sectional area which is greater than that of a compensation piston (23) of the compensation cylinder (22).

6. An apparatus for fine blanking of workpieces from a material, comprising:

a press plate having a V-ring;

a blanking punch guided in said press plate;

a ram comprising a die plate opposed to said press plate and a counterholder opposed to said blanking punch;

a V-ring cylinder connected to said press plate;

at least one compensation cylinder connected to said ram, wherein said V-ring cylinder is in hydraulic equilibrium with said compensation cylinder, and the at least one compensation cylinder is hydraulically connected to the V-ring cylinder through a hydraulic connection, said hydraulic connection also having a connection to an oil tank via a logic valve; and a main cylinder connected to said ram.

* * * * *